US010967410B2

(12) United States Patent
Lee et al.

(10) Patent No.: US 10,967,410 B2
(45) Date of Patent: Apr. 6, 2021

(54) COOLING DEVICE AND COOLING METHOD

(71) Applicant: POSCO, Pohang-si (KR)

(72) Inventors: Pil-Jong Lee, Pohang-si (KR); Jong-Hoon Kang, Pohang-si (KR); Hui-Seop Kwon, Pohang-si (KR); Gwan-Sik Min, Pohang-si (KR)

(73) Assignee: POSCO, Pohang-si (KR)

( * ) Notice: Subject to any disclaimer, the term of this patent is extended or adjusted under 35 U.S.C. 154(b) by 370 days.

(21) Appl. No.: 16/064,440

(22) PCT Filed: Jul. 27, 2016

(86) PCT No.: PCT/KR2016/008206
§ 371 (c)(1),
(2) Date: Jun. 20, 2018

(87) PCT Pub. No.: WO2017/111242
PCT Pub. Date: Jun. 29, 2017

(65) Prior Publication Data

US 2019/0001385 A1 Jan. 3, 2019

(30) Foreign Application Priority Data

Dec. 23, 2015 (KR) ..... 10-2015-0184745

(51) Int. Cl.
*B21B 45/02* (2006.01)

(52) U.S. Cl.
CPC ..... *B21B 45/0233* (2013.01); *B21B 45/0218* (2013.01)

(58) Field of Classification Search
CPC ..... B21B 45/023; B21B 45/0218
See application file for complete search history.

(56) References Cited

U.S. PATENT DOCUMENTS 4,371,149 A * 2/1983 Takeuchi ..... C21D 1/667 266/113
8,634,953 B2 1/2014 Soderland
(Continued)

FOREIGN PATENT DOCUMENTS

CN 101507980 A 8/2009
CN 201287148 Y 8/2009
(Continued)

OTHER PUBLICATIONS

International Search Report dated Nov. 4, 2016 issued in Internationanl Patent Application No. PCT/KR2016/008206 (with English translation).
(Continued)

*Primary Examiner* — Scott R Kastler
(74) *Attorney, Agent, or Firm* — Morgan, Lewis & Bockius LLP

(57) ABSTRACT

The present invention relates to a cooling device and a cooling method capable of controlling, by section, the flow of coolant supplied in a widthwise direction, the cooling device comprising: a base frame connected to an external cooling fluid supply line, and disposed to be able to spray coolant onto a material that passes through a rolling mill after having been heated in a heating furnace; and a nozzle assembly disposed on the base frame, and spraying a cooling fluid in an arbitrary pattern onto a plurality of sections divided along the widthwise direction of the material to minimize a deviation in temperature in the widthwise direction of the material. Through this configuration, the flow of coolant supplied in the widthwise direction of a material can be controlled to be varied, thereby being capable of minimizing a deviation in temperature in the widthwise direction of a high temperature material.

12 Claims, 17 Drawing Sheets

(56) References Cited

U.S. PATENT DOCUMENTS

| | | | | |
|---|---|---|---|---|
| 2010/0132426 | A1* | 6/2010 | Baumgartel | B21B 37/74 72/342.2 |
| 2013/0111965 | A1 | 5/2013 | Lee | |
| 2019/0001385 | A1* | 1/2019 | Lee | B21B 45/0233 |

FOREIGN PATENT DOCUMENTS

| | | | |
|---|---|---|---|
| CN | 201291227 | Y | 8/2009 |
| CN | 102189127 | A | 9/2011 |
| CN | 104024817 | A | 9/2014 |
| EP | 0153688 | A1 | 9/1985 |
| EP | 2799830 | A1 | 11/2014 |
| JP | S63-13610 | A | 1/1988 |
| JP | 2013-099774 | A | 5/2013 |
| JP | 2015-503749 | A | 2/2015 |
| KR | 10-0241018 | B1 | 3/2000 |
| KR | 20-0414939 | Y1 | 4/2006 |
| KR | 10-2012-0053744 | A | 5/2012 |
| KR | 10-2013-0046938 | A | 5/2013 |
| KR | 10-1490622 | B1 | 2/2015 |
| KR | 10-1557725 | B1 | 10/2015 |

OTHER PUBLICATIONS

Extended European Search Report dated Dec. 20, 2018 issued in European Patent Application No. 16879110.1.
Chinese Office Action dated Feb. 22, 2019 issued in Chinese Patent Application No. 201680075542.2.

* cited by examiner

【Figure 1】
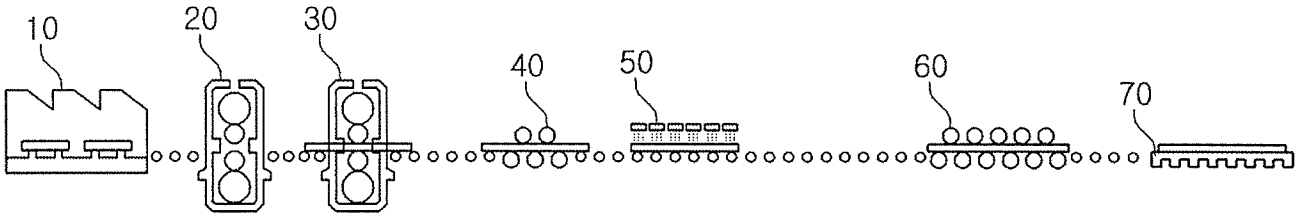

【Figure 2】
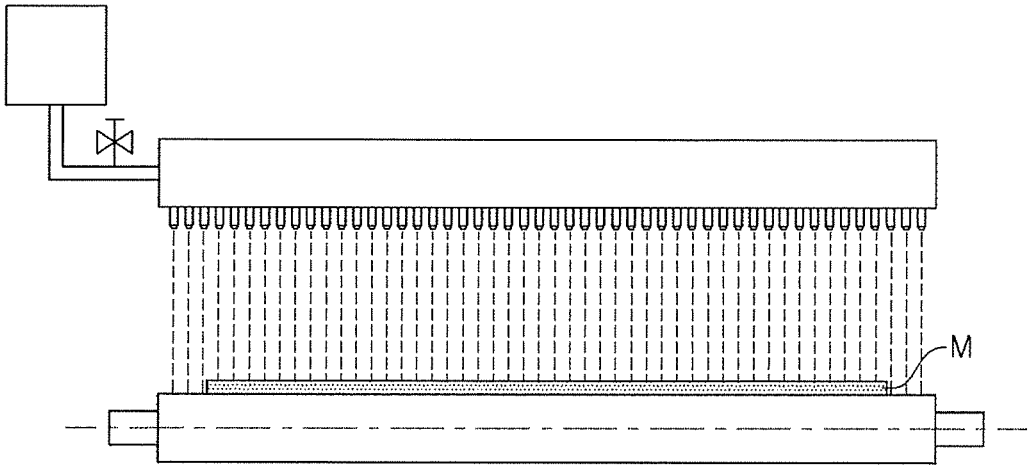
【Figure 3】
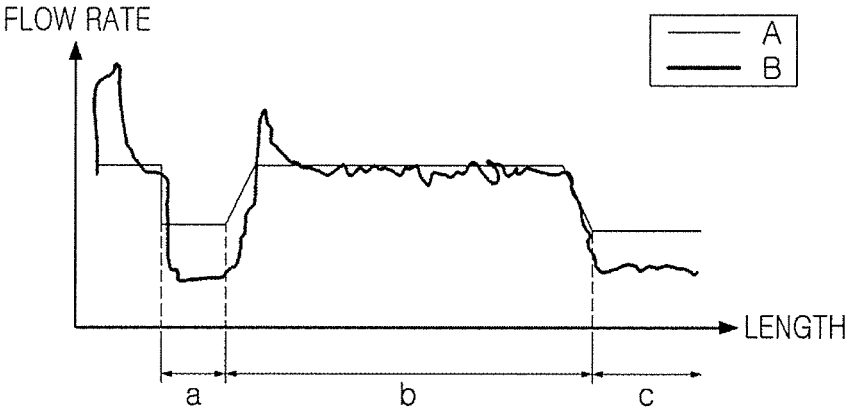
5

【Figure 4】
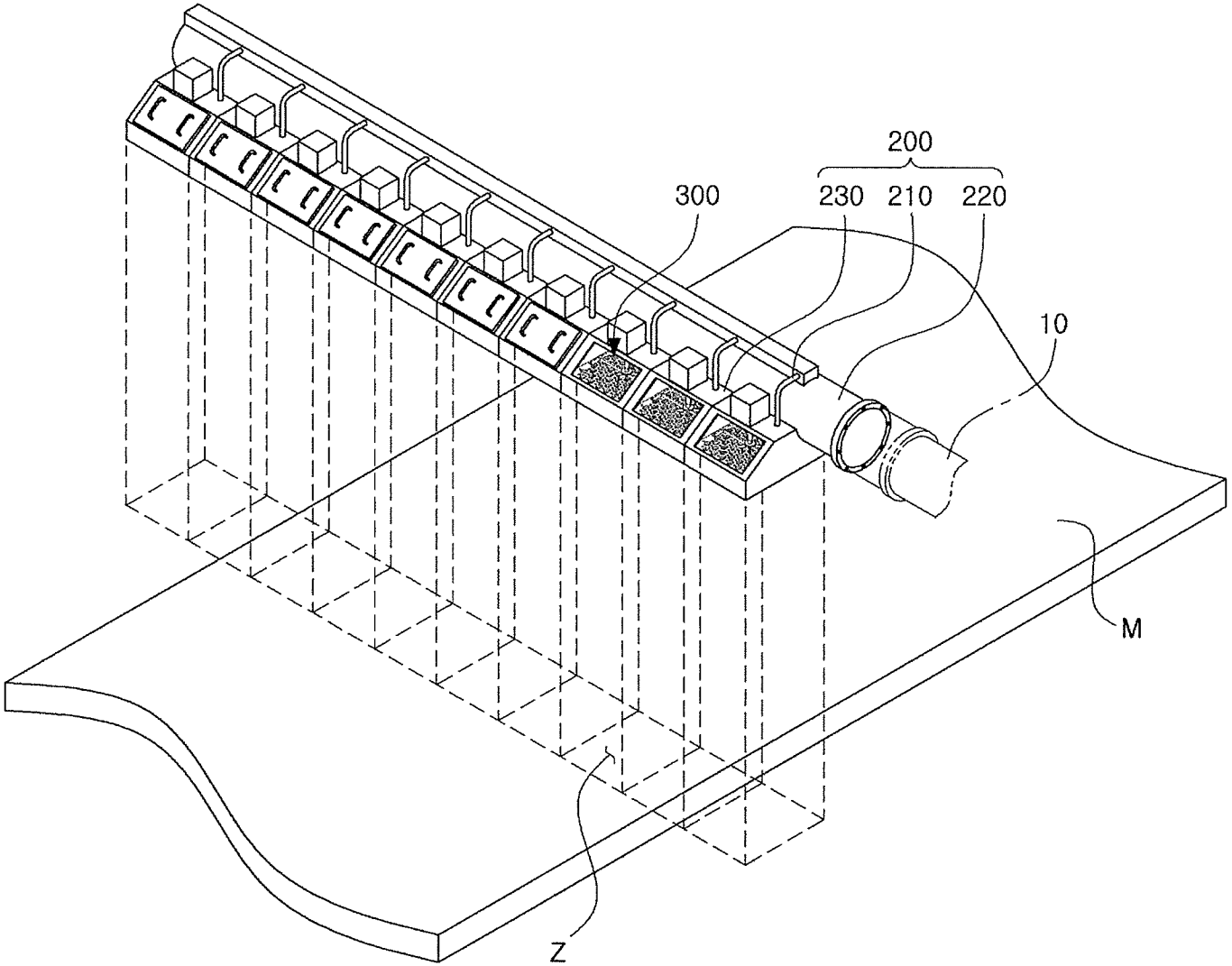

【Figure 5】
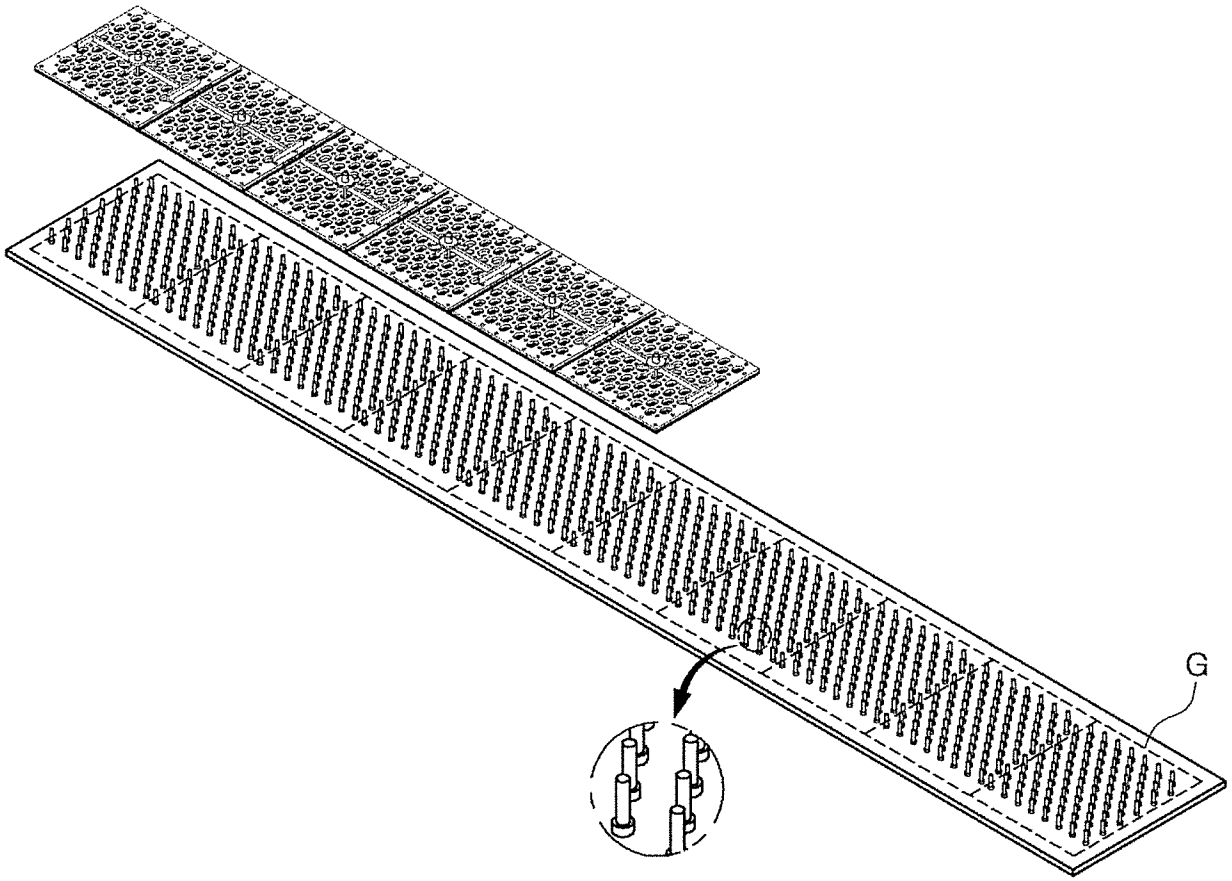

【Figure 6】
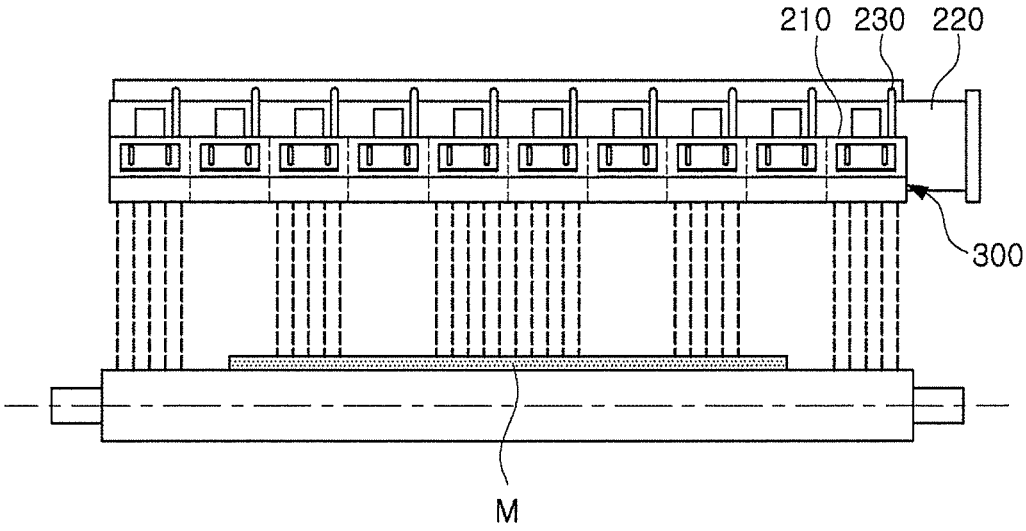
【Figure 7】
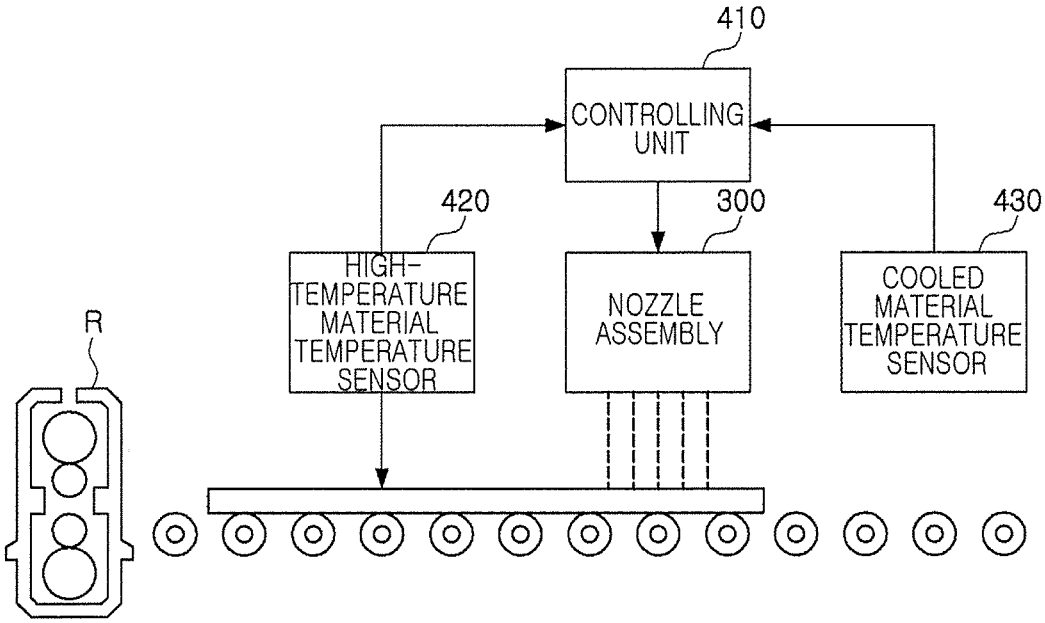

【Figure 8】
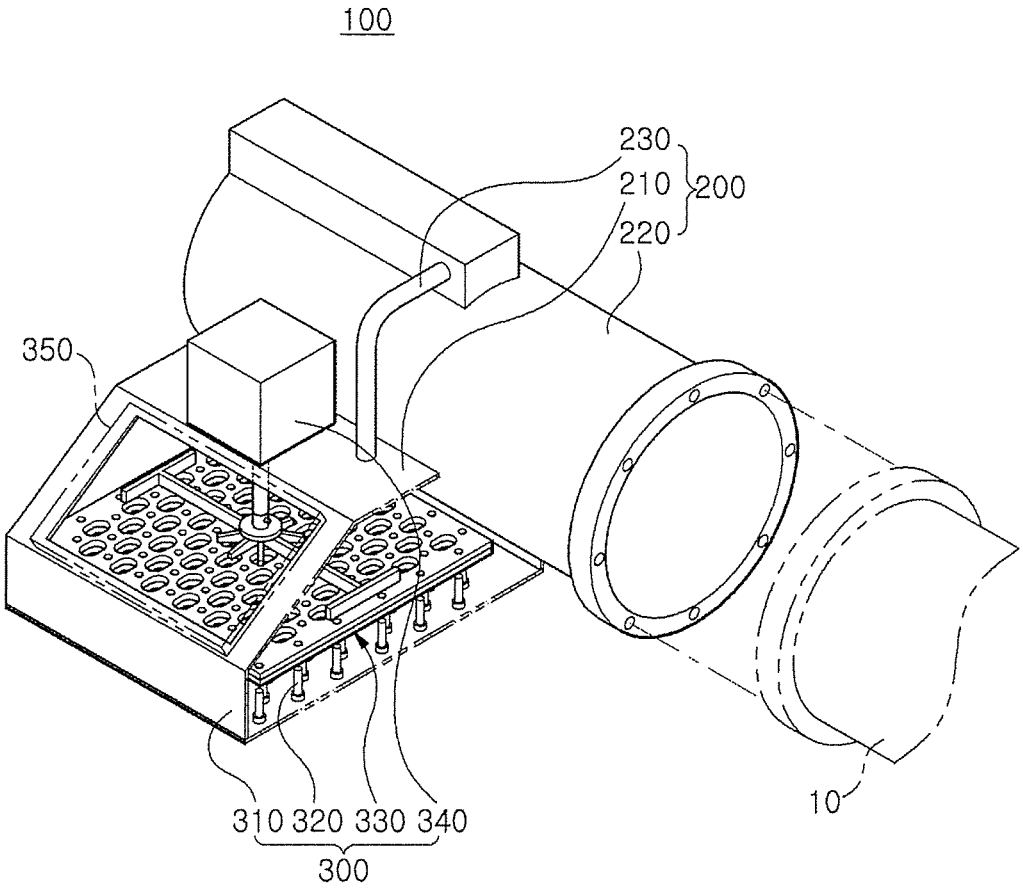

【Figure 9】
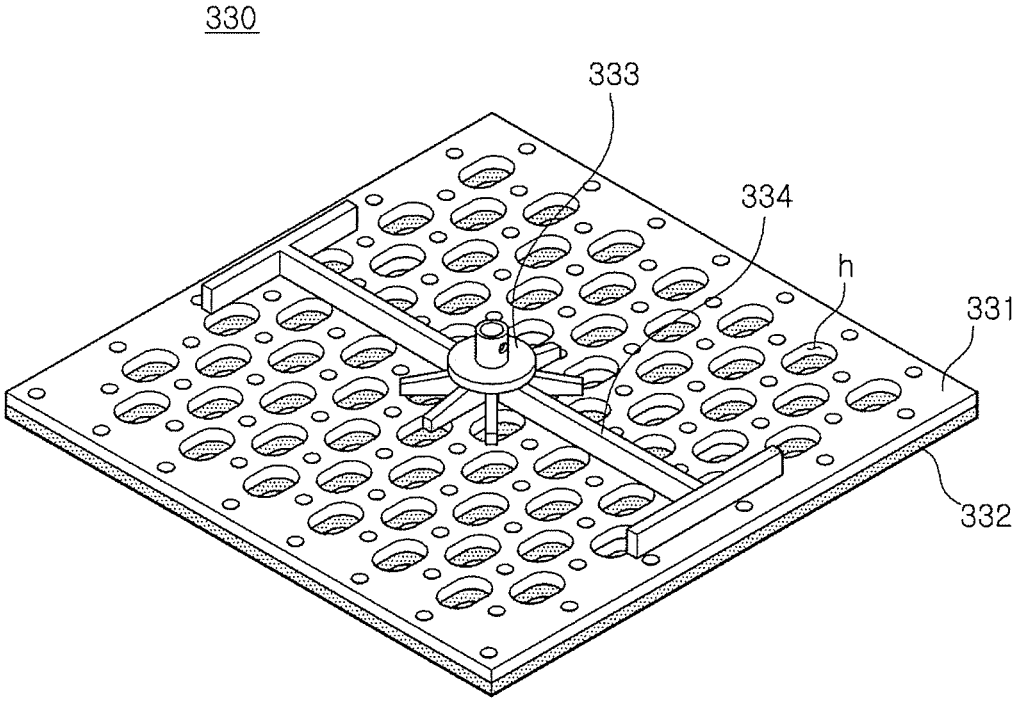

【Figure 10】
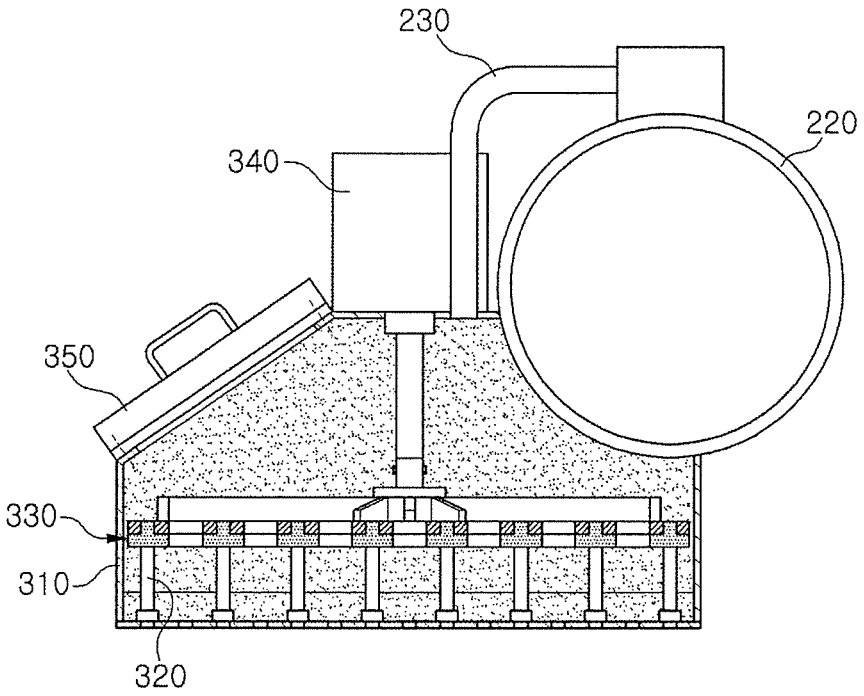

【Figure 11】
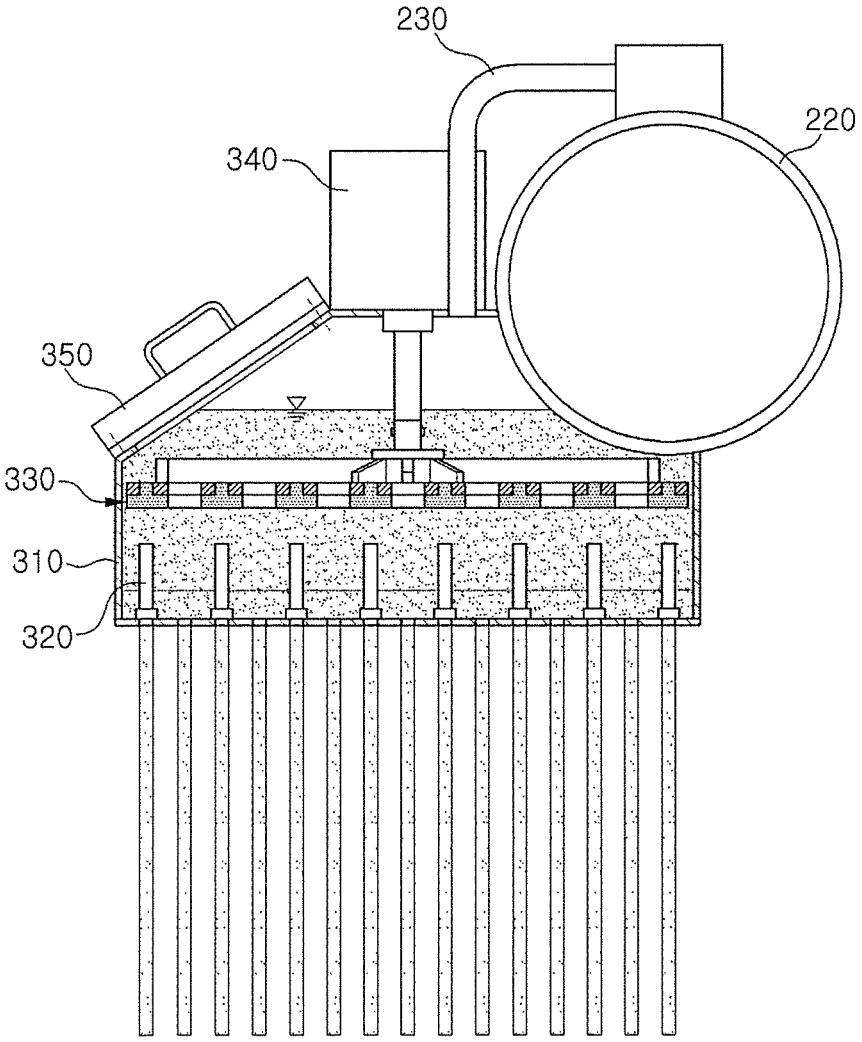

【Figure 12】
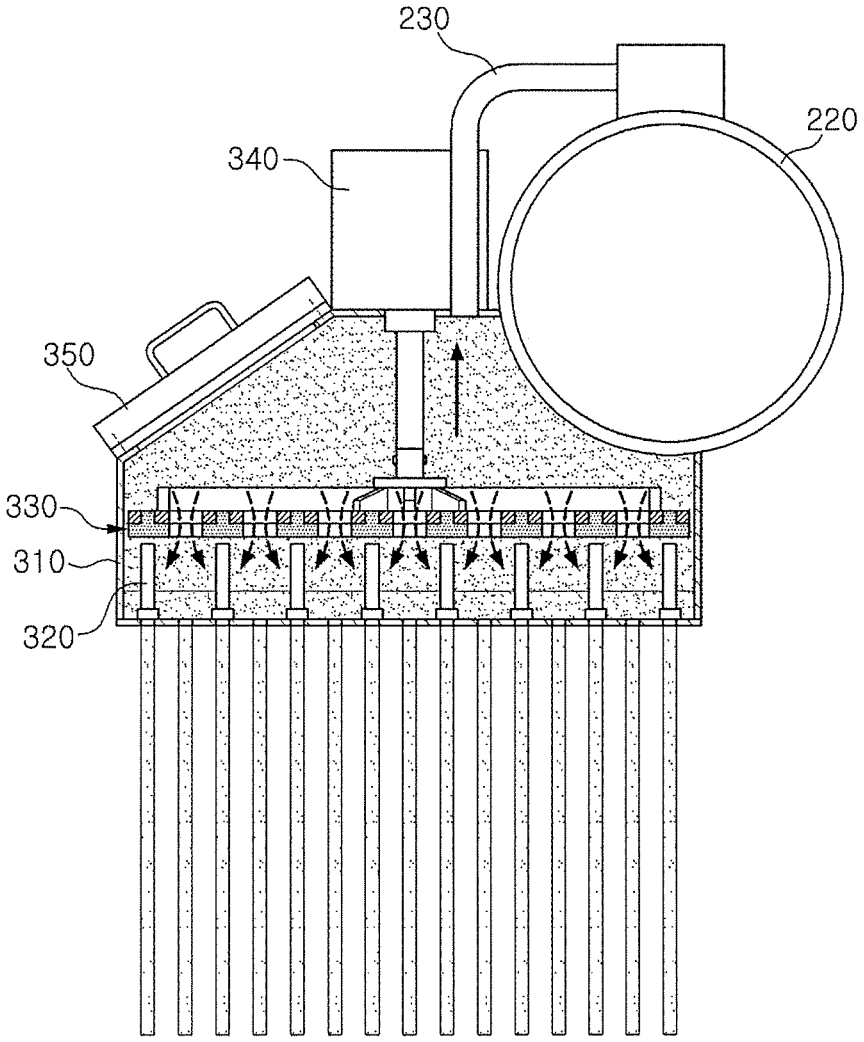

【Figure 13】
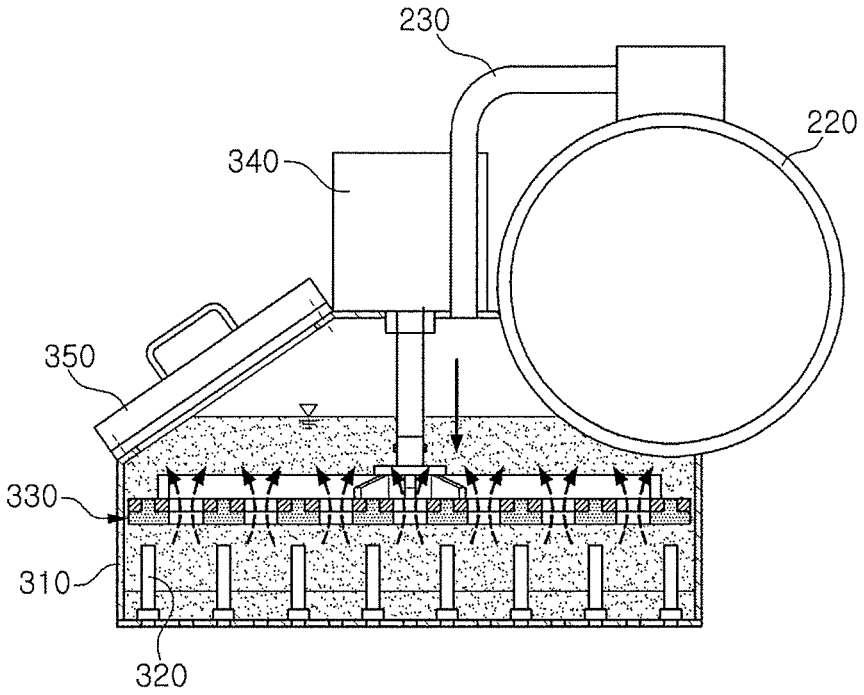

【Figure 14】
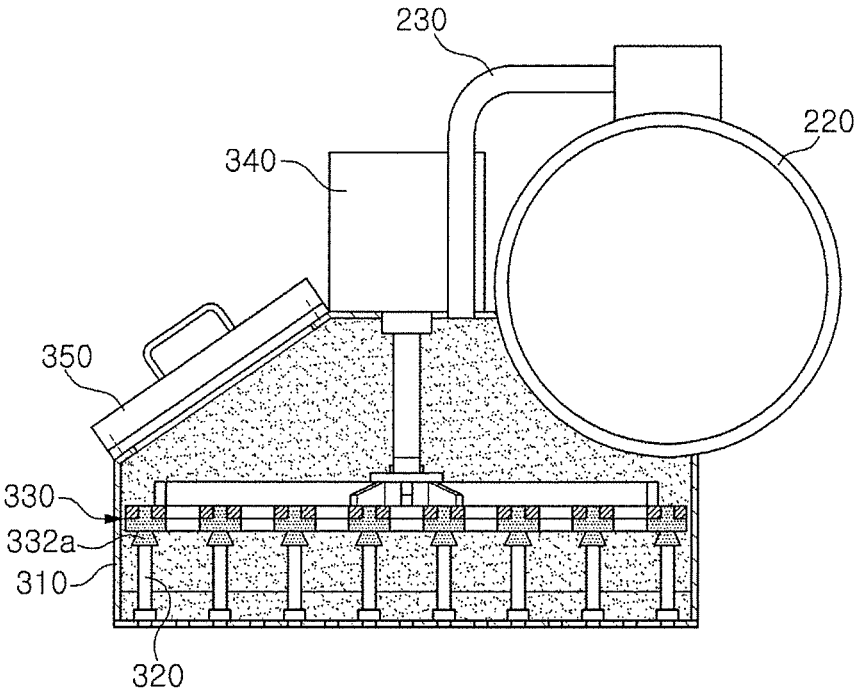

【Figure 15】
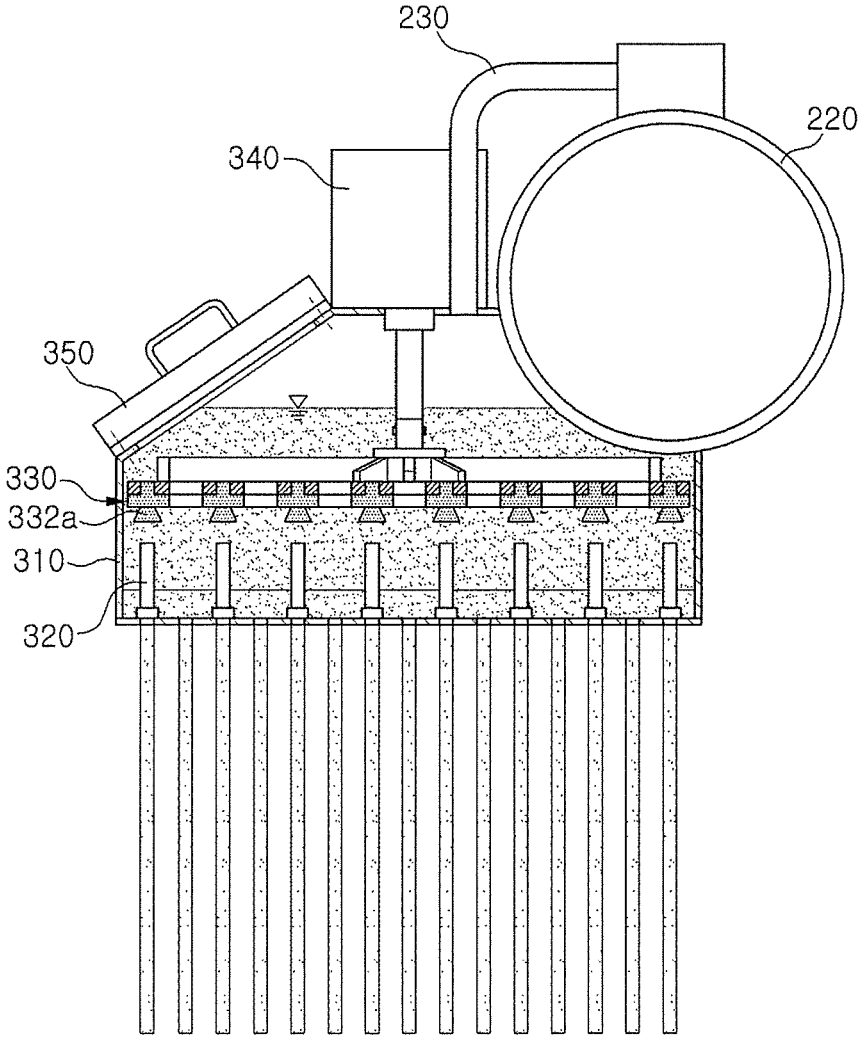

【Figure 16】
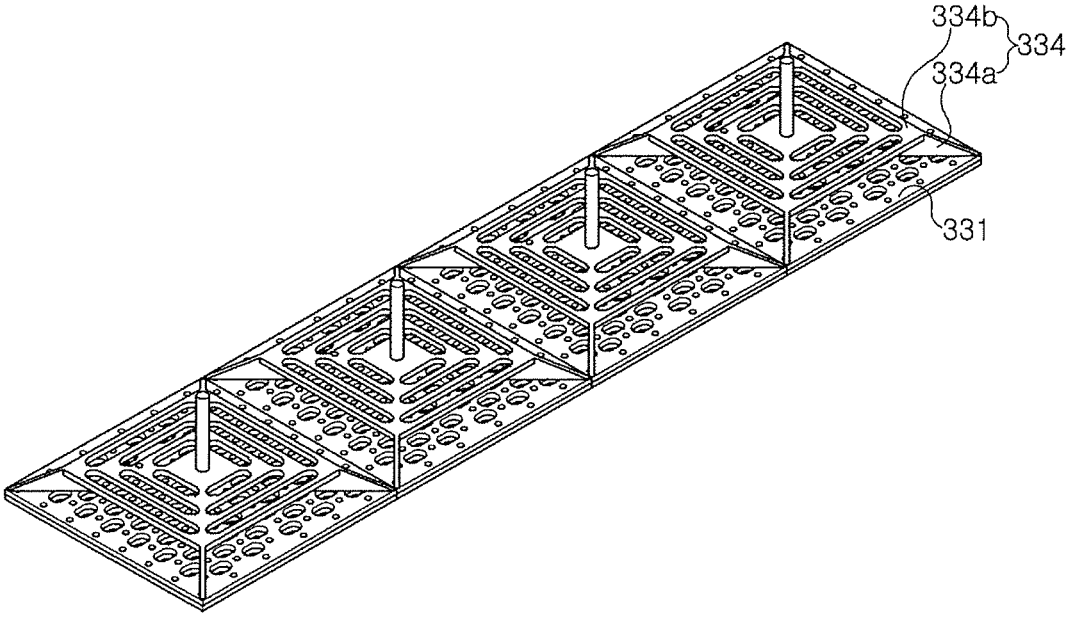

【Figure 17】
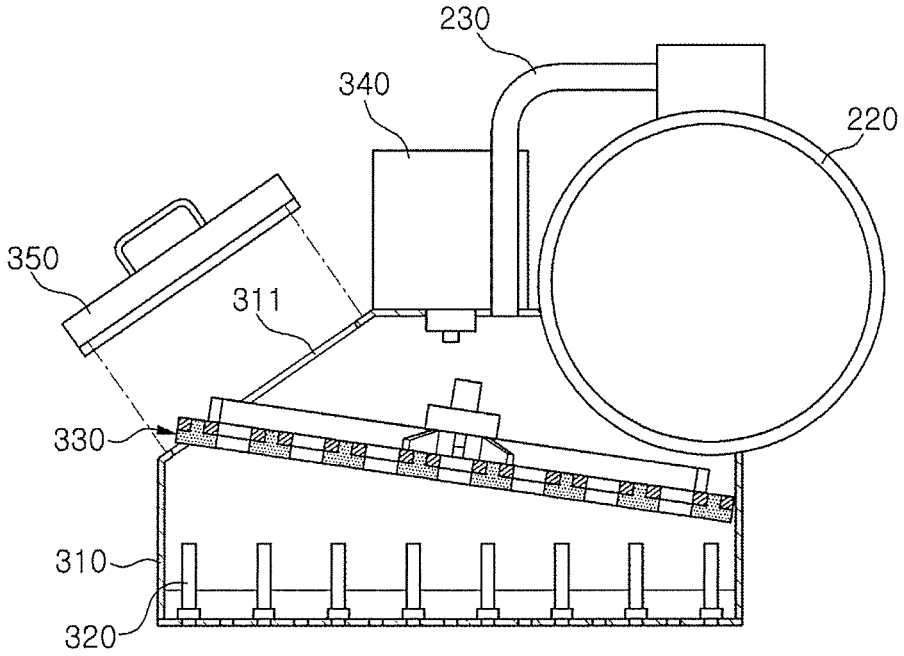

【Figure 18】
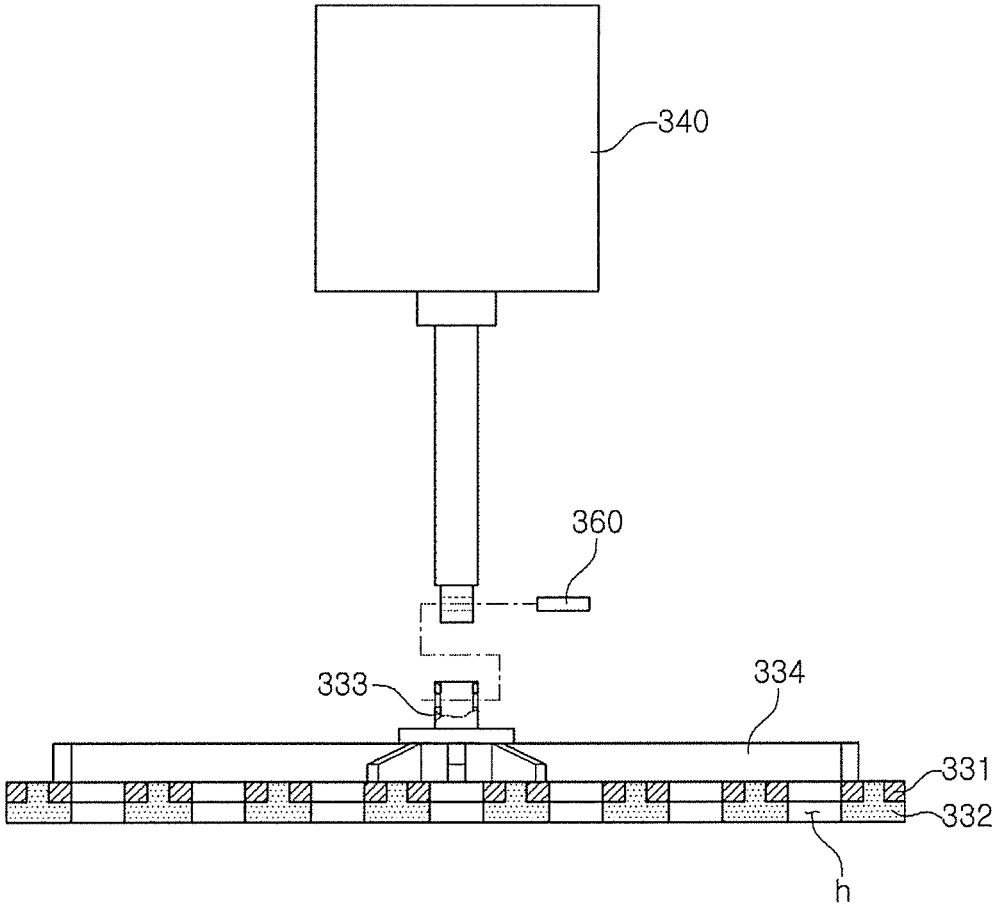

【Figure 19】
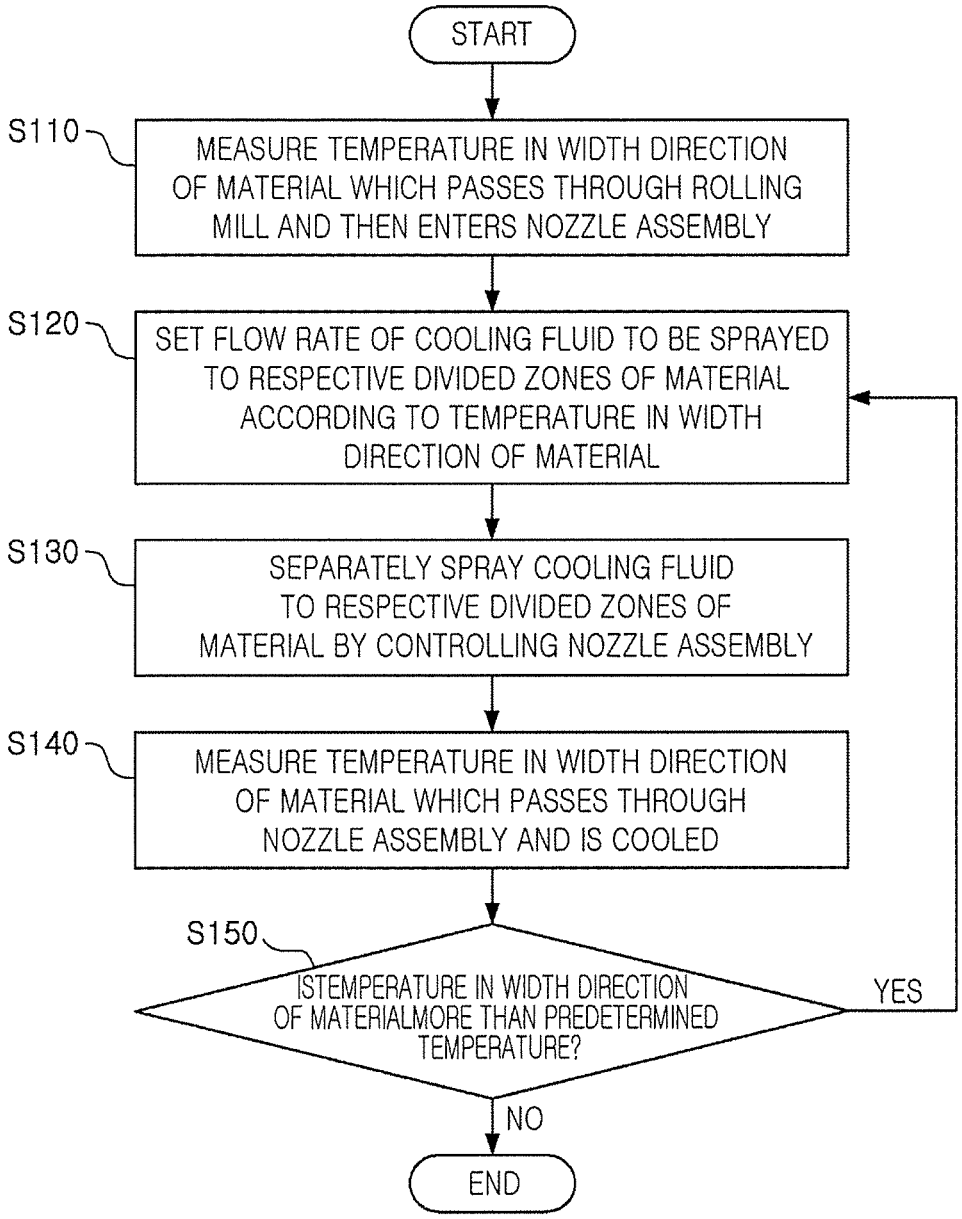

COOLING DEVICE AND COOLING METHOD

CROSS REFERENCE

This patent application is the U.S. National Phase under 35 U.S.C. § 371 of International Application No. PCT/KR2016/008206, filed on Jul. 27, 2016, which claims the benefit of Korean Patent Application No. 10-2015-0184745, filed on Dec. 23, 2015, the entire contents of each are hereby incorporated by reference.

TECHNICAL FIELD

The present disclosure relates to a cooling device and a cooling method, and more particularly, to a cooling device and a cooling method in which a flow rate of coolant supplied in a width direction may be controlled in respective zones.

BACKGROUND ART

FIG. 1 is a view schematically illustrating a general thick plate process line. Referring to FIG. 1, a material is led out from a heating furnace 10 in a high temperature state, passes through a widthwise rolling mill 20 and a lengthwise rolling mill 30, and is preliminarily leveled in a preliminary leveler 40, and is then accelerated and cooled in a cooling device 50. In addition, the accelerated and cooled material passes through a hot leveler 60 and is shape-leveled, and is then cooled in a cooling bed 70.

Here, the conventional cooling device 50 is configured to spray a predetermined amount of coolant in a width direction of the material, as illustrated in FIG. 2. However, when the predetermined amount of coolant is sprayed in the width direction of the material, since a central portion of the material has a smaller area in contact with the coolant than a volume thereof, a cooling effect in the central portion of the material is lowered, and since edge portions of the material have a wide area which is in contact with the coolant, the cooling effect at the edge portion of the material is increased. As a result, there is a problem in that a temperature deviation may occur throughout the material.

Further, to reduce temperature deviations in a length direction of the material, a technology has been performed for controlling a flow rate of coolant supplied to a head end portion (a), a central portion (b), and a tail end portion (c) of the material according to an indicated flow rate profile for a time illustrated in FIG. 3 when the material is cooled. The above-mentioned technology tracks a position of the moving material and adjusts a flow rate of the corresponding position with a valve.

However, since the flow rate of coolant supplied to cool the material corresponds to several tons, there may be a problem in that it takes about 3 seconds to adjust the flow rate with the valve and it takes about 10 seconds or more to stabilize the supplied flow rate. Accordingly, since the flow rate of coolant sprayed to the material does not have time to accurately follow the set indicated flow rate profile, a large deviation in the flow rate of coolant which is actually supplied to the head end portion (a) and the tail end portion (c) may occur, resulting in a temperature deviation in the material.

DISCLOSURE

Technical Problem

An aspect of the present disclosure is to provide a cooling device and a cooling method, in which a flow rate of a coolant supplied in a width direction may vary to significantly reduce a temperature deviation with respect to a width direction of a high temperature material and to supply the coolant corresponding to a width of the material.

An aspect of the present disclosure is to provide a cooling device and a cooling method capable of significantly reducing the time required for operations of supplying and shutting off a flow rate to follow an indicated flow rate profile, to significantly reduce a temperature deviation occurring in a length direction of a high temperature material.

Technical Solution

According to an aspect of the present disclosure, a cooling device includes a base frame connected to an external cooling fluid supplying line and disposed to spray a coolant to a material which is heated in a heating furnace and then passes through a rolling mill; and a nozzle assembly disposed on the base frame and spraying a cooling fluid to a plurality of zones, divided in a width direction of the material, in any pattern to significantly reduce a temperature deviation in the width direction of the material.

The nozzle assembly may be disposed on the base frame to be supplied with the cooling fluid, nozzles may be formed in a plurality of rows and columns, a predetermined number of nozzles may form a group to be divided into a plurality of group nozzles, and the group nozzles may be opened and closed to spray the cooling fluid to predetermined zones.

The base frame may be disposed above a moving material, and the plurality of group nozzles of the nozzle assembly may be disposed in line to be parallel to the width direction of the material.

The nozzle assembly may selectively spray the cooling fluid to a specific zone in the width direction of the material by separately opening and closing the plurality of group nozzles.

The nozzle assembly may be provided to spray a flow rate of the cooling fluid sprayed in the width direction of the material to be different for each of the group nozzles by controlling the plurality of group nozzles to be separately opened and closed.

The nozzle assembly may be provided to discharge a predetermined amount of cooling fluid through group nozzles positioned at both ends among the plurality of group nozzles to prevent an occurrence of water hammering in zones in which the cooling fluid is stored and supplied.

The cooling device may further include a high-temperature material temperature sensor disposed upstream of the nozzle assembly and measuring a temperature in the width direction of the material which enters the nozzle assembly; and a controlling unit controlling the nozzle assembly to adjust a flow rate of the cooling fluid sprayed in the width direction of the material in response to temperature data in the width direction of the material received from the high-temperature material temperature sensor.

The cooling device may further include a cooled material temperature sensor disposed downstream of the nozzle assembly and measuring a temperature in the width direction of the material passing through the nozzle assembly, wherein the controlling unit controls the nozzle assembly by resetting the flow rate of the cooling fluid to be sprayed to the respective divided zones of the material in consideration of a temperature deviation when the temperature deviation in the width direction of the material received from the cooled material temperature sensor is higher than a predetermined temperature.

The base frame may include a support frame provided with the nozzle assembly; a storage pipe disposed on the support frame and connected to the cooling fluid supplying line to store the cooling fluid; and a supply pipe connecting between the nozzle assembly and the storage pipe to supply the cooling fluid to the nozzle assembly.

The nozzle assembly may include a housing in which the cooling fluid is stored; the plurality of nozzles provided to protrude to the inside of the housing and having through holes formed in a length direction to spray the cooling fluid to the outside; a plurality of masks disposed on the plurality of group nozzles to open and close each of the group nozzles; and a plurality of actuators disposed on the housing and separately moving the plurality of masks in a vertical direction.

The nozzle assembly may control a flow rate of the cooling fluid sprayed to the outside by adjusting an interval between the masks and the nozzles.

The mask may include a base plate in which a plurality of flow holes through which the cooling fluid flows are formed and having one side surface fastened to the actuator; and an elastic member disposed on the other side surface of the base plate, having holes formed in positions corresponding to the flow holes of the base plate, and sealing the through holes of the nozzles when the nozzles are closed.

The base plate of the mask may include a fastening part protruding from the center of one side surface thereof and fastened to the actuator; and a reinforcing rib extending from the fastening part to a circumference of the base plate to prevent a deformation of the base plate.

The reinforcing rib may include a plurality of first ribs extending from the fastening part to the respective corners of the base plate; and second ribs disposed on the plurality of first ribs and connecting between the plurality of first ribs.

The elastic member may further include a protrusion protruding from a portion which is closely in contact with the nozzle and pressurizing and sealing the nozzle.

The mask may be provided to be detached from the actuator.

The housing may include a penetrating part provided to be in communication with the outside and formed to have a size appropriate for the mask to be pulled out or inserted; and a door part opening and closing the penetrating part of the housing.

According to another aspect of the present disclosure, a cooling method includes a high-temperature material temperature measuring step of measuring a temperature in a width direction of a material which passes through a rolling mill and then enters a nozzle assembly; a spray flow rate setting step of dividing the material into predetermined zones in the width direction and setting a flow rate of a cooling fluid to be sprayed to the respective divided zones according to the temperature in the width direction of the material; and a coolant spraying step of separately spraying the cooling fluid to the respective divided zones of the material by controlling the nozzle assembly in which a plurality of group nozzles are formed in line in the width direction of the material.

In the spray flow rate setting step, to prevent an occurrence of water hammering in zones in which the cooling fluid is stored and supplied, a predetermined amount of cooling fluid may be set to be discharged through group nozzles positioned at both ends among the plurality of group nozzles.

The nozzle assembly may selectively spray the cooling fluid to a specific zone in the width direction of the material by separately opening and closing the plurality of group nozzles.

The nozzle assembly may be provided to control the plurality of group nozzles to be separately opened and closed, and spray the flow rate of the cooling fluid sprayed in the width direction of the material to be different for each of the group nozzles.

The cooling method may further include a cooled material temperature measuring step of measuring a temperature in the width direction of the material which passes through the nozzle assembly and is cooled, wherein when a temperature deviation in the width direction of the material measured in the cooled material temperature measuring step is higher than a predetermined temperature, a flow rate of the cooling fluid to be sprayed to the respective divided zones of the material is again set in the spray flow rate setting step in consideration of the temperature deviation.

Advantageous Effects

As set forth above, in a cooling device and a cooling method according to an exemplary embodiment in the present disclosure, since the flow rate of the coolant supplied in the width direction of the material maybe controlled to be varied, the temperature deviation in the width direction of the high temperature material may be significantly reduced.

In addition, according to an exemplary embodiment, a nozzle opening and closing means may be provided to improve an opening and closing response speed of the nozzle, and the coolant may be simultaneously sprayed through a plurality of nozzles to quickly stabilize the sprayed flow rate of the coolant, thereby stably following the indicated flow rate profile.

DESCRIPTION OF DRAWINGS

FIG. 1 is a view schematically illustrating a general thick plate process line.

FIG. 2 is a schematic view schematically illustrating a cooling device applied to the conventional thick plate process line.

FIG. 3 is a graph obtained by comparing an indicated flow rate profile with an actual flow rate using the conventional cooling device.

FIG. 4 is a perspective view schematically illustrating a cooling device according to an exemplary embodiment in the present disclosure.

FIG. 5 is a perspective view schematically illustrating a plurality of group nozzles in the cooling device according to an exemplary embodiment in the present disclosure.

FIG. 6 is a front view schematically illustrating an operating state of the cooling device according to an exemplary embodiment in the present disclosure.

FIG. 7 is a block diagram schematically illustrating the cooling device according to an exemplary embodiment in the present disclosure.

FIG. 8 is an enlarged perspective view schematically illustrating one portion of the cooling device according to an exemplary embodiment in the present disclosure.

FIG. 9 is a perspective view schematically illustrating a mask extracted from the cooling device according to an exemplary embodiment in the present disclosure.

FIG. 10 is a cross-sectional view schematically illustrating a state in which a nozzle is closed in the cooling device according to an exemplary embodiment in the present disclosure.

FIG. 11 is a cross-sectional view schematically illustrating a state in which a nozzle is opened in the cooling device according to an exemplary embodiment in the present disclosure.

FIG. 12 is a view schematically illustrating a state in which a cooling fluid moves through a flow hole of a mask when the nozzle is opened in the cooling device according to an exemplary embodiment in the present disclosure.

FIG. 13 is a view schematically illustrating a state in which a cooling fluid moves through a flow hole of a mask when the nozzle is closed in the cooling device according to an exemplary embodiment in the present disclosure.

FIG. 14 is a cross-sectional view schematically illustrating a state in which the nozzle is closed using a mask according to another exemplary embodiment in the cooling device according to an exemplary embodiment in the present disclosure.

FIG. 15 is a cross-sectional view schematically illustrating a state in which the nozzle is opened using a mask according to another exemplary embodiment in the cooling device according to an exemplary embodiment in the present disclosure.

FIG. 16 is a perspective view schematically illustrating a mask according to another exemplary embodiment extracted from the cooling device according to an exemplary embodiment in the present disclosure.

FIG. 17 is a state view schematically illustrating a state in which the mask is replaced in the cooling device according to an exemplary embodiment in the present disclosure.

FIG. 18 is a view schematically illustrating a state in which the mask is detached from the cooling device according to an exemplary embodiment in the present disclosure.

FIG. 19 is a flowchart schematically illustrating a cooling method according to an exemplary embodiment in the present disclosure.

BEST MODE FOR INVENTION

To facilitate understanding of the features of the present disclosure, hereinafter, a cooling device and a cooling method according to exemplary embodiments in the present disclosure will be described in more detail.

It is to be noted that in giving reference numerals to components of each of the accompanying drawings to facilitate understanding of exemplary embodiments to be described below, the same components will be denoted by the same reference numerals even though they are shown in different drawings. Further, in describing exemplary embodiments in the present disclosure, well-known configurations or functions will not be described in detail since they may obscure the subject matter of the present disclosure.

Hereinafter, exemplary embodiments in the present disclosure will be described with reference to the accompanying drawings.

FIG. 4 is a perspective view schematically illustrating a cooling device according to an exemplary embodiment in the present disclosure and FIG. 5 is a perspective view schematically illustrating a plurality of group nozzles in the cooling device. FIG. 6 is a front view schematically illustrating an operating state of the cooling device and FIG. 7 is a block diagram schematically illustrating the cooling device. FIG. 8 is an enlarged perspective view schematically illustrating one portion of the cooling device and FIG. 9 is a perspective view schematically illustrating a mask extracted from the cooling device. FIGS. 10 and 11 are cross-sectional views schematically illustrating states in which a nozzle is closed and opened in the cooling device and FIGS. 12 and 13 are views schematically illustrating state in which a cooling fluid moves through a flow hole of a mask when the nozzle is opened and closed in the cooling device.

Referring to FIGS. 2 through 13, a cooling device 100 according to an exemplary embodiment in the present disclosure may include a base frame 200 connected to an external cooling fluid supplying line 10 and disposed to spray a coolant to a material M which is heated in a heating furnace and then passes through a rolling mill, and a nozzle assembly 300 disposed on the base frame 200 and spraying the cooling fluid to a plurality of zones Z, divided in a width direction of the material, in any pattern to significantly reduce a temperature deviation in the width direction of the material M.

The nozzle assembly 300 may be disposed on the base frame 200 to be supplied with the cooling fluid, nozzles 320 may be formed in a plurality of rows and columns, a predetermined number of nozzles 320 may form a group to be divided into a plurality of group nozzles G, and the group nozzles G may be opened and closed to spray the cooling fluid to predetermined zones.

That is, a plurality of nozzles 320 may be provided and a predetermined number of nozzles 320 may be grouped into the group nozzle G. Since the cooling fluid may be simultaneously sprayed to predetermined zones Z by simultaneously opening the predetermined number of nozzles 320, a supplied flow rate may be stabilized within a relatively fast time, thereby stably following an indicated flow rate profile. Here, the cooling fluid may be provided as a coolant, and may be provided to cool a high-temperature material by free-falling onto the high-temperature material due to self weight when the nozzles 320 are opened.

In addition, the nozzle assembly 300 may be provided to selectively spray the cooling fluid to a specific zone Z by opening at least one group nozzle G of the plurality of group nozzles G.

More specifically, in a case in which the nozzle assembly 300 is disposed in a width direction of the high-temperature material M and the group nozzles G of the nozzle assembly 300 are disposed in line in the width direction of the high-temperature material M, the nozzle assembly 300 may be provided to cool only a specific zone Z of the high-temperature material M by selectively opening a specific group nozzle of the plurality of group nozzles G.

For example, as illustrated in FIG. 6, in a case in which ten group nozzles are disposed, the nozzle assembly 300 may be operated to spray the cooling fluid by closing second, fourth, seventh, and ninth group nozzles and opening first, third, fifth, sixth, eighth, and tenth group nozzles from the left in the drawing.

According to the above-mentioned configuration, since the cooling fluid may be selectively sprayed to the specific zone in the width direction of the high-temperature material M, a temperature deviation in the width direction may be significantly reduced. That is, the nozzle assembly 300 is operated so that a large amount of cooling fluid may be sprayed to high-temperature zones in the high-temperature material M in which the large amount of cooling fluid needs to be sprayed by opening two or three group nozzles of positions corresponding to the high-temperature zones, and is operated so that a relatively small amount of cooling fluid is sprayed to a relatively low-temperature zone by opening one group nozzle or the cooling fluid is not sprayed to the relatively low-temperature zone by closing the group nozzles, thereby significantly reducing the temperature deviation in the width direction.

Further, the first and tenth group nozzles positioned at both ends among the plurality of group nozzles may be always opened while the cooling device is operated so that a predetermined amount of cooling fluid is discharged to prevent an occurrence of water hammering in zones in which the cooling fluid is stored and supplied.

In addition, the cooling device 100 according to an exemplary embodiment in the present disclosure may include a high-temperature material temperature sensor 420 disposed upstream of the nozzle assembly 300 and measuring a temperature in the width direction of the material which is heated in the heating furnace, passes through the rolling mill (R), and then enters the nozzle assembly 300, and a controlling unit 410 controlling the nozzle assembly 300 to adjust a flow rate of the cooling fluid sprayed in the width direction of the material in response to temperature data in the width direction of the material M received from the high-temperature material temperature sensor 420.

That is, the temperature in the width direction of the material M may be measured by the high-temperature material temperature sensor 420 before the material M enters the nozzle assembly 300, and the controlling unit 410 may control the nozzle assembly 300 so that a large flow rate of cooling fluid is sprayed to a zone having a relatively high temperature and a small flow rate of cooling fluid is sprayed to a zone having a relatively low temperature, based on the temperature data in the width direction of the material M.

Further, the cooling device 100 may further include a cooled material temperature sensor 430 disposed downstream of the nozzle assembly 300 and measuring a temperature in the width direction of the material M passing through the nozzle assembly 300.

In this case, if the temperature deviation in the width direction of the material M received from the cooled material temperature sensor 430 is higher than a predetermined temperature, that is, a temperature deviation range that the material has to satisfy, the controlling unit 410 may control the nozzle assembly 300 by resetting a flow rate of the cooling fluid to be sprayed to the respective divided zones of the material M in consideration of the temperature deviation.

According to the above-mentioned configuration, the flow rate of the cooling fluid sprayed to the respective zones may be primarily set through the data measured from the high-temperature material temperature sensor 420 online, and in a case in which the data measured from the cooled material temperature sensor 430 is received, if the temperature deviation in the width direction of the material is a predetermined temperature or more, the flow rate of the cooling fluid sprayed to the respective zones may be secondarily adjusted. Thereby, an optimal spray flow rate of the cooling fluid capable of significantly reducing the temperature deviation of the material M may be set.

The base frame 200 may include a support frame 210 provided with the nozzle assembly 300, a storage pipe 220 disposed on the support frame 210 and connected to the cooling fluid supplying line 10 to store the cooling fluid, and a supply pipe 230 connecting between the nozzle assembly 300 and the storage pipe 220 to supply the cooling fluid to the nozzle assembly 300.

That is, the storage pipe 220 may be connected to the cooling fluid supplying line 10 to be supplied with the cooling fluid, and may be formed to store a larger amount of cooling fluid than an amount of cooling fluid stored in the nozzle assembly 300 in advance to smoothly supply the cooling fluid to the nozzle assembly 300. In addition, the supply pipe 230 may include a valve (not shown) to supply the cooling fluid when the cooling fluid stored in the nozzle assembly 300 becomes a predetermined amount or less.

The nozzle assembly 300 may include a housing 310 in which the cooling fluid is stored, a plurality of nozzles 320 provided to protrude to the inside of the housing 310 and having through holes formed in a length direction to spray the cooling fluid to the outside, a plurality of masks 330 disposed on the plurality of group nozzles to open and close each of the group nozzles, and a plurality of actuators 340 disposed on the housing 310 and separately moving the plurality of masks 330 in a vertical direction.

The housing 310 may have a hollow portion to store a predetermined amount of cooling fluid or more therein, and may have a horizontal lower side surface on which the plurality of nozzles 320 are formed.

In addition, the housing 310 may be elongated so that the group nozzles are disposed in line. In this case, the housing 310 may be disposed in the width direction of the high-temperature material to selectively open the plurality of group nozzles, thereby supplying the cooling fluid to a specific zone in the width direction.

The nozzles 320 may be provided in a plurality of rows and columns in the housing 310 to spray the cooling fluid to a predetermined zone. In addition, the nozzles 320 may protrude to the inside of the housing 310 from the lower side surface of the housing 310, and have the through holes formed in the length direction to spray the cooling fluid to the outside. That is, in a case in which the masks 330 close the nozzles 320, the masks may close the nozzles by pressurizing end portions of the protruding nozzles 320. Thereby, water leak of the cooling fluid may be more effectively prevented. A shape of the nozzles 320 is not limited thereto, and the nozzles 320 may also be provided in any form in which the cooling fluid may be simultaneously sprayed to the predetermined zone.

In addition, the plurality of nozzles 320 may be divided into a plurality of group nozzles by forming a predetermined number of nozzles as a group. For example, in a case in which the nozzles 320 is formed in eight rows and eighty columns in the housing 310, if eight nozzles 320 in a vertical direction and eight nozzles 320 in a horizontal direction are formed as one group nozzle, the nozzles 320 may be divided into a total of ten group nozzles. In this case, the masks 330 may be provided to simultaneously open and close one group nozzle, that is, the eight nozzles 320 in the vertical direction and the eight nozzles 320 in the horizontal direction.

The masks 330 may be disposed inside the housing 310 to be moved vertically, and operate to simultaneously open and close the plurality of nozzles 320 protruding to the inside of the housing 310, that is, one group nozzle to simultaneously spray or block the cooling fluid through the plurality of nozzles 320. In this case, the masks 330 maybe moved vertically by the driving of the actuators 340 disposed on the housing 310. In a case in which the nozzles 320 are opened by moving the masks 330 in a state in which the nozzles 320 are closed, the flow rate of the sprayed cooling fluid may also be controlled by adjusting an interval between the masks 330 and the nozzles 320.

More specifically, the mask 330 may include a base plate 331 in which a plurality of flow holes h through which the cooling fluid may flow is formed and having one side surface fastened to the actuator 340, and an elastic member 332 disposed on the other side surface of the base plate 331, having holes formed in positions corresponding to the flow holes h of the base plate 331, and sealing the through holes of the nozzles 320 when the nozzles 320 are closed.

The base plate 331 may be formed to have an area capable of covering the entire of the plurality of nozzles 320 disposed on the housing 310. To significantly reduce resistance due to the cooling fluid when base plate 331 is moved vertically, the flow holes h may be formed in regions of the base plate 331 other than regions for closing the nozzles 320. That is, when the base plate 331 having a predetermined area is moved in a vertical direction in the housing 310, large resistance due to the cooling fluid occurs by a wide surface area of the base plate 331. As a result, a respond for a control signal is delayed and it is difficult to follow the indicated flow rate profile. Therefore, to secure a rapid response speed, the flow resistance caused when the base plate 331 is moved vertically may be significantly reduced by forming the plurality of flow holes h.

In a case in which the nozzles 320 are opened by moving the base plate 331 upwardly in a state in which the nozzles 320 are closed, as illustrated in FIG. 12, since a large amount of cooling fluid may flow through the plurality of flow holes h formed in the base plate 331, the resistance applied to the base plate 331 may be reduced, thereby significantly reducing deformation of the base plate 331. In addition, even in a case in which the base plate 331 is moved to close the nozzles 320 after a predetermined time, as illustrated in FIG. 11, since a large amount of cooling fluid may flow through the plurality of flow holes h, the resistance applied to the base plate 331 may be reduced.

In addition, the base plate 331 of the mask 330 may include a fastening part 333 protruding from the center of one side surface thereof and fastened to the actuator 340, and a reinforcing rib 334 extending from the fastening part 333 to a circumference of the base plate 331 to prevent the deformation of the base plate 331.

That is, in the base plate 331 having the wide surface area, since bending deformation occurs at four ends of the front and back, right and left around the fastening part 333 when being moved vertically, there is a possibility that a fatigue load is accumulated on the base plate 331 and the base plate is broken when the base plate 331 is used for a long time. Therefore, the base plate may be reinforced with respect to a bending load by forming the reinforcing rib 334 to extend from the fastening part 333 formed at the center of the base plate 331 to the circumference of the base plate 331. In this case, the reinforcing rib 334 may be welded and fastened to the fastening part 333 and one side surface of the base plate 331.

Further, in a case in which the masks 330 are disposed in line in the housing 310 to open and close the nozzles 320, the reinforcing rib 334 maybe formed on the base plate 331 in the same direction as the direction in which the masks 330 are disposed. That is, when the masks 330 are moved vertically, the cooling fluid in the housing 310 is pushed to both sides by the movement of the masks 330, and the pushed cooling fluid is applied to an adjacent mask 330 as a large load to thereby cause breakage of the adjacent mask 330. Therefore, a region of the base plate 331 on which the load is concentrated may be reinforced by forming the reinforcing rib 334 in the same direction as the direction in which the masks 330 are disposed.

FIGS. 14 and 15 are cross-sectional views schematically illustrating state in which the nozzle is closed and opened using a mask according to another exemplary embodiment in the cooling device.

Referring to FIGS. 14 and 15, the elastic member 332 of the mask 330 may further include a protrusion 332*a* protruding on a portion which is closely in contact with the nozzle 320 and pressurizing and sealing the nozzle 320. That is, the elastic member 332 may include the protrusion 332*a* protruding to the nozzle 320 from a region which is closely in contact with the nozzle 320, and may seal the nozzle 320 so that the cooling fluid is not leaked when the nozzle 320 is closed. In this case, the protrusion 332*a* may have a diameter at least larger than the diameter of the nozzle 320.

FIG. 16 is a perspective view schematically illustrating a mask according to another exemplary embodiment extracted from the cooling device.

Referring to FIG. 16, the reinforcing rib 334 provided on the base plate 331 may also include a plurality of first ribs 334*a* extending from the fastening part to the respective corners of the base plate 331, and second ribs 334*b* disposed on the plurality of first ribs 334*a* and connecting between the plurality of first ribs 334*a*, to support the deformation of the base plate 331 with higher rigidity. Of course, the shape and structure of the reinforcing rib 334 are limited thereto, and the reinforcing rib 334 may also be provided in any form in which a phenomenon in which the base plate 331 is bent may be prevented.

FIG. 17 is a state view schematically illustrating a state in which the mask is replaced in the cooling device and FIG. 18 is a view schematically illustrating a state in which the mask is detached from the cooling device.

Referring to FIGS. 17 and 18, the mask 330 may be provided to be detached from the actuator 340. That is, the fastening part 333 formed on the base plate 331 and an action rod of the actuator 340 may be provided to be detached from each other. This is to easily replace only the mask 330 when the mask 330 may not accurately open and close the nozzle 320 due to the deformation of the base plate 331 or corrosion of the elastic member 332 according to a use for long period of time. In this case, the actuator 340 and the fastening part 333 are fastened to each other by a pin 360 as illustrated in FIG. 17, such that the actuator 340 and the fastening part 333 may be more simply fastened to and separated from each other. Of course, the configuration for detaching the actuator 340 and the base plate 331 from each other is not limited thereto, and various mechanical methods may be used.

To this end, the housing 310 may further include a penetrating part 311 provided to be in communication with the outside and formed to have a size in which the mask 330 may be pulled out or inserted, and a door part 350 opening and closing the penetrating part 311 of the housing 310. That is, the door part 350 may close the penetrating part 311 of the housing 310, and may open the inside of the housing 310 by opening the door part 350 when it is necessary to check an inside state of the housing 310 or replace the mask 330. In this case, the door part 350 may be provided to open and close the penetrating part 311 by being rotatably fastened to the housing 310, or to open and close the penetrating part 311 by being provided to be detached from the penetrating part 311.

FIG. 19 is a flowchart schematically illustrating a cooling method according to an exemplary embodiment in the present disclosure.

Referring to FIG. 19, a cooling method may include a high-temperature material temperature measuring step (S110) of measuring a temperature in a width direction of a material which passes through a rolling mill and then enters a nozzle assembly, a spray flow rate setting step (S120) of dividing the material into predetermined zones in the width direction and setting flow rate of a cooling fluid to be sprayed to the respective divided zones according to the temperature in the width direction of the material, and a coolant spraying step (S130) of separately spraying the cooling fluid to the respective divided zones of the material by controlling the nozzle assembly in which a plurality of group nozzles are formed in line in the width direction of the material.

In addition, the cooling method may further include a cooled material temperature measuring step (S140) of measuring a temperature in the width direction of the material which passes through the nozzle assembly and is cooled, wherein when a temperature deviation in the width direction of the material measured in the cooled material temperature measuring step (S140) is higher than a predetermined temperature, that is, a temperature deviation range that the material has to satisfy (Yes in S150), a flow rate of the cooling fluid to be sprayed to the respective divided zones of the material may be again adjusted by returning to the spray flow rate setting step (S120) in consideration of the temperature deviation.

According to the above-mentioned method, the flow rate of the cooling fluid sprayed to the respective zones may be primarily set through data measured from the high-temperature material temperature step (S110) online, and if the temperature deviation in the width direction of the material is more than the predetermined temperature through the data measured from the cooled material temperature measuring step (S140), the flow rate of the cooling fluid sprayed to the respective zones may be secondarily adjusted. Thereby, an optimal spray flow rate of the cooling fluid capable of significantly reducing the temperature deviation of the material may be set.

Here, in the spray flow rate setting step (S120), to prevent an occurrence of water hammering in zones in which the cooling fluid is stored and supplied, a predetermined amount of cooling fluid may be set to be discharged through group nozzles positioned at both ends among the plurality of group nozzles.

In addition, the nozzle assembly may be configured to selectively spray the cooling fluid to a specific zone in the width direction of the material by separately opening and closing the plurality of group nozzles.

In addition, the nozzle assembly may be provided to control the plurality of group nozzles to be separately opened and closed, and may spray the flow rate of the cooling fluid sprayed in the width direction of the material to be different for each of the group nozzles.

As described above, although the present disclosure has been described with reference to exemplary embodiments and the accompanying drawings, it would be appreciated by those skilled in the art that the present disclosure is not limited thereto, but various modifications and alterations might be made without departing from the scope defined in the following claims.

The invention claimed is:

1. A cooling device comprising:

a base frame connected to an external cooling fluid supplying line and disposed to spray a coolant to a material which is heated in a heating furnace and then passes through a rolling mill; and a nozzle assembly disposed on the base frame and spraying a cooling fluid to a plurality of zones, divided in a width direction of the material, in any pattern to significantly reduce a temperature deviation in the width direction of the material, wherein the nozzle assembly includes:

a housing in which the cooling fluid is stored;

the plurality of nozzles provided to protrude to the inside of the housing and having through holes formed in a length direction to spray the cooling fluid to the outside;

a plurality of masks disposed on the plurality of group nozzles to open and close each of the group nozzles; and a plurality of actuators disposed on the housing and separately moving the plurality of masks in a vertical direction.

2. The cooling device of claim 1, wherein the nozzle assembly is disposed on the base frame to be supplied with the cooling fluid, nozzles are formed in a plurality of rows and columns, a predetermined number of nozzles form a group to be divided into a plurality of group nozzles, and the group nozzles are opened and closed to spray the cooling fluid to predetermined zones.

3. The cooling device of claim 2, wherein the base frame is disposed above a moving material, and the plurality of group nozzles of the nozzle assembly are disposed in line to be parallel to the width direction of the material.

4. The cooling device of claim 1, further comprising:

a high-temperature material temperature sensor disposed upstream of the nozzle assembly and measuring a temperature in the width direction of the material which enters the nozzle assembly; and a controlling unit controlling the nozzle assembly to adjust a flow rate of the cooling fluid sprayed in the width direction of the material in response to temperature data in the width direction of the material received from the high-temperature material temperature sensor.

5. The cooling device of claim 4, further comprising: a cooled material temperature sensor disposed downstream of the nozzle assembly and measuring a temperature in the width direction of the material passing through the nozzle assembly, wherein the controlling unit controls the nozzle assembly by resetting the flow rate of the cooling fluid to be sprayed to the respective divided zones of the material in consideration of a temperature deviation when the temperature deviation in the width direction of the material received from the cooled material temperature sensor is higher than a predetermined temperature.

6. The cooling device of claim 1, wherein the base frame includes:

a support frame provided with the nozzle assembly;

a storage pipe disposed on the support frame and connected to the cooling fluid supplying line to store the cooling fluid; and a supply pipe connecting between the nozzle assembly and the storage pipe to supply the cooling fluid to the nozzle assembly.

7. The cooling device of claim 1, wherein the nozzle assembly controls a flow rate of the cooling fluid sprayed to the outside by adjusting an interval between the masks and the nozzles.

8. The cooling device of claim 1, wherein the mask includes:

a base plate in which a plurality of flow holes through which the cooling fluid flows are formed and having one side surface fastened to the actuator; and an elastic member disposed on the other side surface of the base plate, having holes formed in positions corresponding to the flow holes of the base plate, and sealing the through holes of the nozzles when the nozzles are closed.

9. The cooling device of claim 8, wherein the base plate of the mask includes:

a fastening part protruding from the center of one side surface thereof and fastened to the actuator; and a reinforcing rib extending from the fastening part to a circumference of the base plate to prevent a deformation of the base plate.

10. The cooling device of claim 9, wherein the reinforcing rib includes:

a plurality of first ribs extending from the fastening part to the respective corners of the base plate; and second ribs disposed on the plurality of first ribs and connecting between the plurality of first ribs.

11. The cooling device of claim 8, wherein the elastic member further includes a protrusion protruding from a portion which is closely in contact with the nozzle and pressurizing and sealing the nozzle.

12. The cooling device of claim 8, wherein the mask is provided to be detached from the actuator, the housing includes:

a penetrating part provided to be in communication with the outside and formed to have a size appropriate for the mask to be pulled out or inserted; and a door part opening and closing the penetrating part of the housing.

* * * * *